US008128040B2

(12) United States Patent
Blessman

(10) Patent No.: US 8,128,040 B2
(45) Date of Patent: Mar. 6, 2012

(54) METHOD AND DEVICE FOR INSERTING A FOOD STUFF INTO A PLIABLE BAG

(76) Inventor: Brad Blessman, Denver, CO (US)

( * ) Notice: Subject to any disclaimer, the term of this patent is extended or adjusted under 35 U.S.C. 154(b) by 0 days.

(21) Appl. No.: 12/896,466

(22) Filed: Oct. 1, 2010

(65) Prior Publication Data

US 2011/0016832 A1 Jan. 27, 2011

Related U.S. Application Data

(63) Continuation of application No. 11/744,011, filed on May 3, 2007, now Pat. No. 7,810,766, which is a continuation of application No. 10/856,590, filed on May 28, 2004, now Pat. No. 7,246,641, which is a continuation-in-part of application No. 10/387,655, filed on Mar. 12, 2003, now Pat. No. 6,839,923.

(51) Int. Cl.
*B65B 67/04* (2006.01)

(52) U.S. Cl. ..... 248/99; 248/97; 141/98; 141/114; 141/391

(58) Field of Classification Search ..... 248/99, 248/97, 100; 141/98, 114, 391
See application file for complete search history.

(56) References Cited

U.S. PATENT DOCUMENTS

| | | | | |
|---|---|---|---|---|
| 359,617 | A | 3/1887 | Leonard | |
| 743,505 | A | 11/1903 | Heffner | |
| 804,456 | A | 11/1905 | Condo | |
| 827,008 | A | 7/1906 | Gilmore | |
| 1,140,583 | A | 5/1915 | Elliott | |
| 1,144,187 | A | 6/1915 | Garren | |
| 1,665,907 | A | 4/1928 | Coda | |
| 1,712,711 | A | 5/1929 | Morgan et al. | |
| 1,743,329 | A | 1/1930 | Dougherty | |
| 2,778,324 | A | 1/1957 | Mattson | |
| 2,935,107 | A | 5/1960 | Bertelsen et al. | |
| 2,939,614 | A * | 6/1960 | Hill | 222/190 |

(Continued)

FOREIGN PATENT DOCUMENTS

GB 2 248 177 4/1992

(Continued)

OTHER PUBLICATIONS

International Search Report for International (PCT) Patent Application No. PCT/US05/18608 mailed Oct. 27, 2006.

(Continued)

*Primary Examiner* — Amy J. Sterling
(74) *Attorney, Agent, or Firm* — Sheridan Ross P.C.

(57) ABSTRACT

A method and device of inserting a food stuff into a food stuff bag is disclosed, with the method involving providing a substantially flexible resilient food stuff support that is generally "U" shaped when viewed from its operative position on a countertop, inserting at least a first end of the device a short depth into an opening of a pliable bag, such first end having an edge that is curved and opposing sides that are substantially straight. A bending mechanism bends so that at least the first end deforms from a first configuration to a second configuration for insertion of the first end through the bag opening and into an interior of the bag, wherein when the forces are reduced, the first end changes shape toward the first configuration for holding a portion of the bag and for providing an open volume within the bag for transferring a food stuff to the interior of the bag.

20 Claims, 6 Drawing Sheets

U.S. PATENT DOCUMENTS

| | | | | | |
|---|---|---|---|---|---|
| 3,448,913 | A | | 6/1969 | Wolff | |
| 3,837,634 | A | | 9/1974 | Cobb | |
| 3,936,087 | A | | 2/1976 | Alexander | |
| 4,012,799 | A | | 3/1977 | Rutherford | |
| 4,192,494 | A | | 3/1980 | Mima | |
| 4,749,011 | A | | 6/1988 | Rylander | |
| 4,761,872 | A | | 8/1988 | Buettner et al. | |
| 5,065,965 | A | | 11/1991 | Aulabaugh | |
| 5,121,779 | A | * | 6/1992 | Green | 141/337 |
| 5,472,790 | A | | 12/1995 | Thompson | |
| 5,511,255 | A | | 4/1996 | Schuerch | |
| 5,673,446 | A | | 10/1997 | Moen et al. | |
| 5,687,781 | A | | 11/1997 | Grizz | |
| 5,716,033 | A | | 2/1998 | Gibson | |
| 5,797,567 | A | * | 8/1998 | Magnafici | 248/97 |
| 6,035,908 | A | * | 3/2000 | Hoffmann | 141/331 |
| 6,045,097 | A | * | 4/2000 | Gaffar | 248/95 |
| 6,065,512 | A | | 5/2000 | Munn, II | |
| 6,116,549 | A | * | 9/2000 | Santa Cruz et al. | 248/97 |
| 6,273,156 | B1 | | 8/2001 | Carrillo | |
| 6,367,747 | B1 | | 4/2002 | Mulle | |
| 6,371,470 | B1 | | 4/2002 | Ward | |
| 6,460,841 | B1 | | 10/2002 | Durr | |
| 6,651,970 | B2 | | 11/2003 | Scott | |
| 6,839,923 | B2 | | 1/2005 | Blessman | |
| 7,246,641 | B2 | | 7/2007 | Blessman | |
| 7,588,217 | B1 | * | 9/2009 | Rooker | 248/95 |
| 7,958,580 | B2 | * | 6/2011 | Zorger | 5/489 |
| 2003/0189141 | A1 | | 10/2003 | Turvey et al. | |
| 2007/0187558 | A1 | | 8/2007 | Blodgett | |
| 2007/0205337 | A1 | | 9/2007 | Blessman | |
| 2008/0302924 | A1 | | 12/2008 | Albert | |
| 2009/0313951 | A1 | | 12/2009 | Hanson | |

FOREIGN PATENT DOCUMENTS

| | | |
|---|---|---|
| WO | WO 01/26524 | 4/2001 |

OTHER PUBLICATIONS

Written Opinion for International (PCT) Patent Application No. PCT/US05/18608 mailed Oct. 27, 2006.

* cited by examiner

METHOD AND DEVICE FOR INSERTING A FOOD STUFF INTO A PLIABLE BAG

CROSS REFERENCE TO RELATED APPLICATION

The present invention is a continuation of U.S. patent application Ser. No. 11/744,011 filed May 3, 2007, which is a continuation U.S. patent application Ser. No. 10/856,590 filed May 28, 2004 (now U.S. Pat. No. 7,246,641), which is a continuation-in-part of U.S. patent application Ser. No. 10/387,655 filed Mar. 12, 2003 (now U.S. Pat. No. 6,839,923).

FIELD OF THE INVENTION

The present invention is directed to a method and device for insertion of a food stuff into a pliable bag, and more particularly is directed to a flexible, preferably planar, device that facilitates ready insertion into a pliable bag in order to create a three dimensional cavity into which a food stuff can be inserted.

BACKGROUND OF THE INVENTION

Traditional methods of inserting a food stuff into a pliable bag create inconveniences to the individual trying to accomplish the task. There are many traditional methods of performing this task including: sliding the food stuff from a surface, e.g., a cutting board, into a food storage bag, lifting the food into one's hands and then manually providing the food stuff in the storage bag, etc.

Each of the methods mentioned above are awkward and inefficient. Moreover, as with any transfer of food, sanitation and cleanliness can be problematic. Thus, reducing the handling, moving, or contacting of any food stuff by any article or a person's hands is generally beneficial.

There is, therefore, a long felt and unsolved need for an easy, inexpensive and efficient method and device for inserting a food stuff into a pliable bag, wherein there is a reduction in contacting the food stuff during the transfer of the food stuff (e.g., a sandwich, sliced or diced vegetables or fruit, sliced or whole portions of meat, fresh produce, pastries such as cookies, and more flowable food stuffs such as nuts or grains, grated cheese and beans.

SUMMARY OF THE INVENTION

The present invention is generally directed to a method and device to make the process of inserting a food stuff into a flexible and pliable bag (i.e., a bag that will not retain, of its own accord, a shape suitable for conveniently providing food therein) more convenient and sanitary. Thus, the present invention is not only easier, and more efficient in depositing food stuff into food bags, but additionally reduces contact with potentially contaminated objects or matter. In particular, the apparatus of the present invention includes a bendable device (e.g., a bendable foodstuff tray, bendable cutting board or other bendable food supporting article) configured appropriately to be inserted, in a bent or bowed configuration, into a pliable bag for thereby holding the bag open and giving the bag a shape suitable for sliding or pouring the foodstuff on the device into the bag. Because the pliable bag is opened in three dimensions (at least near or about the bag's opening), the bag acquires a shape such that a food stuff may easily be inserted with reduced contact. Accordingly, the present method and device for inserting of a food stuff into a pliable bag is useful in the food processing, hospitality and medical industries, and more generally in any industry that packages food stuffs, such as restaurants. The increased efficiency in pliable bagging or packaging accorded by the present invention allows food processing workers to work more efficiently and hygienically. Additionally, the present invention can be particularly useful for personal use in the kitchen.

Since food stuffs come in several sizes, the device of the present invention can be modified to be larger or smaller dependent on the size of the food stuffs and pliable bags to be used. One embodiment of the invention is created with flexible material, such as lexan polycarbonate, that can be bent (or smoothly deformed) by a user maintaining a deforming force thereon. In particular, a user of the device of the present invention can deform the device, while a food stuff resides thereon, into a shape suitable for insertion into a pliable bag, but once the user ceases to apply (or reduces) the deforming force, the device can return at least as much as the bag will allow to an original state. Accordingly, if such an original state is substantially planar, then the device can be suitable for retaining the bag in an open configuration. Thus, an embodiment of the device may first used for processing the food stuff thereon (e.g., cutting, slicing, dicing, mashing, grating, separating, washing, drying, or straining), and then used to retain a pliable bag in an open configuration for sliding, or pouring the processed food stuff into the bag.

In one embodiment, the device of the present invention (also referred to herein as a bag opener) may be a flexible cutting board, wherein a food stuff thereon can be processed (e.g., sliced, cut, diced, etc.), and wherein the device is configured for easy insertion and subsequent extraction from a pliable bag when deformed. However, embodiments of the device of the present invention are not limited to cutting boards. Thus, it is within the scope of the present invention that the device be suitable for straining or drying food stuffs, washing food stuffs, sanitizing food stuffs (e.g., via ultraviolet light), sizing food stuffs (e.g., smaller food items falling through a mesh while retaining larger food items), etc.

As mentioned above, the device of the present invention may be provided in one or more sizes that are substantially dependent on the pliable bags into which the food stuff is to be deposited. However, if the material from which the device is made is sufficiently resiliently formable, a single size and configuration of the device may be used for various pliable bag sizes in that the device can be deformed a greater amount to fit into a smaller bag, and deformed a lesser amount when inserted into a larger bag. It is important, however, that the device be sufficiently deformable (e.g., manually) so that when a bag insertion end is inserted into a pliable bag, and the device deforming force is relaxed, that the bag is maintained in an open configuration (e.g., a bag volume at least about the opening of the bag is maintained) during the transfer of the foodstuff on the device to the bag. Thus, the extent (i.e., "insertion width") of the device that fits across (and into) the bag opening must be larger than the largest linear dimension the opening of the bag is capable of assuming (e.g., when the bag is lying flat). In particular, the bag insertion width should be approximately at least 1⅜ to 2 times the largest linear dimension the opening of the bag is capable of assuming.

Moreover, the device of the present invention may have deforming force characteristics that are appropriate to the characteristics of the bag into which the device is to be inserted. For example, a device deforming force for a conventional sandwich bag may be less than a device deforming force for a zip lock quart size bag. Accordingly, since the thickness of the flexible material from which the device of the present invention is formed may substantially determine the deforming force, an embodiment of the device of the present invention may be thicker as the pliable bags get larger, and correspondingly stronger.

It is a further aspect of the present invention that the device may be substantially planar (e.g., a cutting board) with generally "U", shaped, "T" shaped or an inverted triangular shape (e.g., "∇") when viewed from its operative position on, e.g., a countertop, wherein the portion of the device corresponding to the lower portion of the "U", "T" or "∇" is the portion of the device that is inserted into the bag. However, other shapes are also possible. In particular, it is important that the portion inserted into a food stuff bag have no sharp corners that could snag, tear, cut the bag.

Since it is important that a food stuff bag easily slide onto the bag opener, the edges of the insertion end of the bag opener should, at least in some embodiments, form a smooth contour having tangents that are acutely angled relative to the general direction of the flow of food stuff from the bag opener into a food stuff bag. In particular, such acute angles may be between 20 and 70 degrees relative to the general direction of the flow of food stuff from the bag opener into a food stuff bag, and the insertion edge may have such a contour over at least a majority of the length of the "initial" insertion end edge of the bag opener, wherein this "initial" insertion end edge is the extent of the edge of the bag opener inserted initially into the bag up to the point where about ⅔ to ¾ of the entire width of the portion of the bag opener ultimately provided in the bag (assuming the width were measured with the bag opener in a flattened state). Accordingly, such a contoured edges of the "initial" insertion end edge (or indeed, the entire insertion end) may include substantially circular, elliptical, other curved non-straight contours. Alternatively, some of the insertion end may include straight edge portions that are acutely angled relative to the general direction of the flow of food stuff from the bag opener into a food stuff bag. Moreover, in some embodiments it is preferable for such a contour to cover at least ¾ of the length of the "initial" insertion end edge of the bag opener.

The device also has edges that smoothly blend into one another so that there are no pointed or sharp portions that could damage a pliable bag into which the device is inserted. Moreover, the edges of the device are sufficiently dull so as to not cut a bag during insertion, and also not cut a user.

Adjacent to the user interface edge of the device (i.e., opposite the rounded bag insertion end of the device), there is preferably a handle or gripping structure to facilitate insertion and removal of the device from a pliable bag. Handholds having an elliptical shape can be formed in the in the device for such a purpose, or more ergonomic handles can be provided thereon for both ease in bending the bag opener, and positioning the bag opener on an optional inclined support. Note that the inclined support is an accompanying apparatus for supporting the bag opener in an inclined position without requiring a user to manually maintain the bag opener in an inclined position while depositing a food stuff into a pliable bag.

Addition to an apparatus, the present invention further includes a method for inserting a food stuff into a pliable bag utilizing one or more of the embodiments of the present invention, e.g., as described above. Such a method comprises opening a pliable bag, inserting a food stuff insertion end of the device of the present invention into the opening of the pliable bag, sliding, pouring, jiggling, or pushing a food stuff along the surface of the bag opener until it enters the pliable bag, and finally removing the bag opener from the bag. Additionally, the method of the present invention may further include providing the bag opener on an embodiment of the above mentioned inclined support prior to transferring the food stuff to the pliable bag.

More generally, the present invention is also directed to a method and device to make the process of inserting any flowable or slidable items into a pliable bag that will not retain, of its own accord, a shape suitable for conveniently providing the items therein. Thus, the present invention is at least easier, and more efficient for depositing such flowable or slidable items into the pliable bags. Note that such items (in addition to food stuff) may be, e.g., soil, bolts (and/or nuts therefor), buttons, beads, marbles, bearings, screws, nails, leaves (and/or other yard debris such as branches), trash, clothes, etc. In particular, this more general embodiment of the present invention includes a bendable device (e.g., a bendable item tray) configured appropriately to be inserted, in a bent or bowed configuration, into a pliable bag for thereby holding the bag open and giving the bag a shape suitable for sliding or pouring the items on the tray into the bag. Because the pliable bag is opened in three dimensions (at least near or about the bag's opening), it acquires a shape such that items may easily be inserted with reduced contact and effort. Accordingly, the present method and device for inserting of items into a pliable bag is useful in various industries such as landscaping and yard cleanup, packaging of various products (e.g., bearings, soil, beads, etc.). The increased efficiency in pliable bagging or packaging accorded by the present invention allows workers to work more efficiently. Moreover, by providing an accompanying inclined support therewith, additional efficiencies may be gained in that a user need not hold the bag opener in position. Thus, e.g., the bag opener (with a bag attached thereto) may remain on the inclined support for an extended period of time while the bag is being filled. Accordingly, embodiments of the present invention may be particularly useful in cleanup or gathering operations where: (i) the items do not fit well in a rigid container (e.g., items such as branches), and/or (ii) a sufficient number of rigid containers are not available.

The present invention is also directed to making and distributing the bag opener and/or related devices such as the above referenced inclined support as well as packaging or enclosures for storing or distributing one or more bag openers and related devices.

Other aspects and embodiments of the present invention can be further understood by referring to the drawings below as well as to the Detailed Description of the Preferred Embodiments of the present invention. It should be understood that all of such embodiments comprise various aspects and embodiments of the present invention and that the Summary of the Invention is by no means to be interpreted as limiting in any regard.

DETAILED DESCRIPTION

Figure 1:
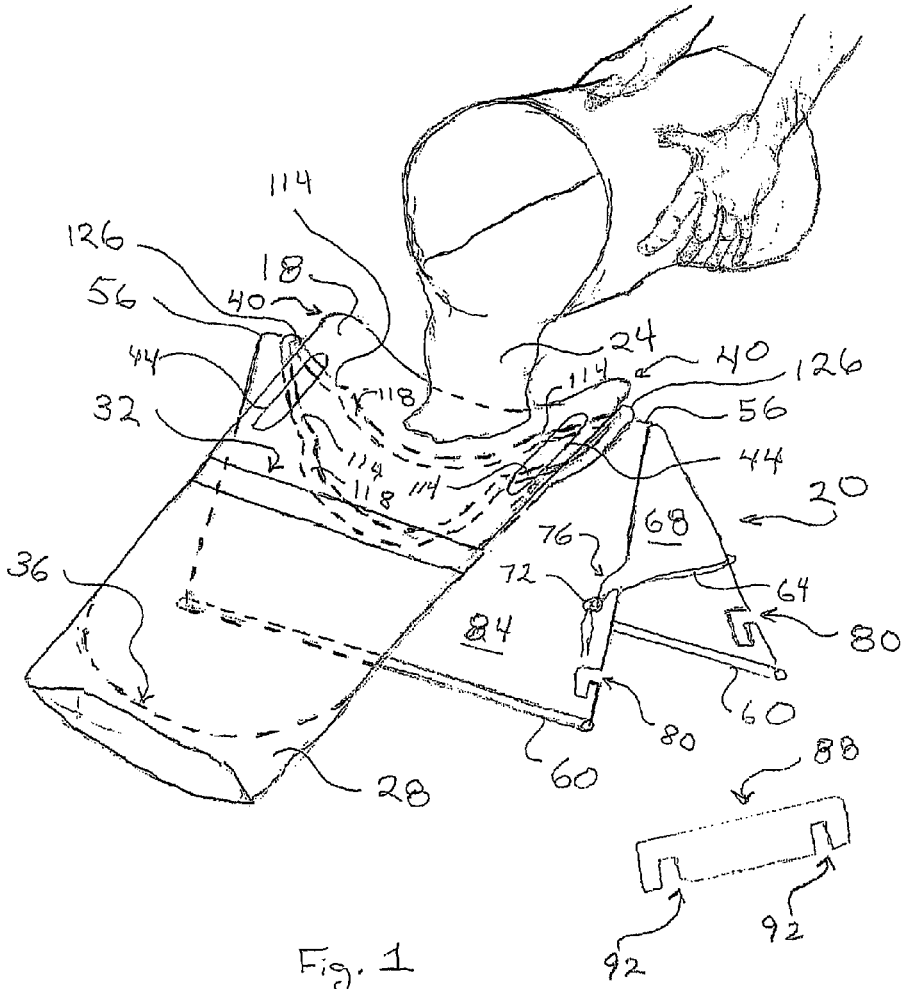
FIG. 1 shows an operative configuration of one embodiment of the current invention.

One aspect of the present invention is directed to a device or bag opener 18 (FIGS. 1, 2, 4-10) to facilitate the insertion of a food stuff into a pliable bag, such a device comprising a generally planar sheet of flexible material. The material can be made from any suitable composition, and may, therefore, comprise paper, cardboard, plastic, rubber, fiberglass, thin metal, etc. and laminates thereof depending on the use therefor. In a preferred embodiment, the material utilized is a plastic material that has considerable flexibility associated therewith so that the planar material can be configured into a generally U-shaped cross sectional configuration and/or rolled into a substantially round (e.g., O-shaped) configuration to facilitate insertion into a pliable bag opening. Moreover, in at least some embodiments of the invention, the planar flexible material must be reasonably resistant to scratching or marring with, e.g., a knife in that the embodiment may also serve as a cutting board or other working surface for use sharp or pointed instruments.

Once the bag opener 18 of the present invention (more specifically, an "insertion end" thereof) is inserted into a pliable bag in its bent or bowed configuration, the bag opener is permitted to expand at least partially toward its normal static configuration; i.e., a less bent configuration. In one scenario, the pliable bag itself will restrain the device from achieving a planar configuration, and thus the device will be tightly held against at least the pliable bag in a bowed configuration thereby providing an appropriate opening for transferring food from the device into the pliable bag. In another scenario, the user controls the degree to which the device is allowed to unbend within the pliable bag. In particular, the user may allow the device to unbend only sufficiently to hold the pliable bag in an open position, but not so much as to tear or irreversibly distort or stretch the pliable bag (such bags being typically made of a stretchable plastic). Accordingly, in such a scenario the user may fix, tie or restrain the device in bowed configuration that maintains an opening into the bag, but does not subject the bag to sufficient force to damage or distort the bag. In either of these scenarios, however, a three-dimensional cavity will be formed inside the interior regions of a pliable bag and a food stuff can therefore be readily inserted within such cavity. Once a food stuff is inserted, the device can then be readily removed from the pliable bag by, e.g., pulling on a portion of the device that is external to the pliable bag while holding (or otherwise securing the bag, if necessary) so that the bag does not move therewith. Thus, it is an aspect of the present invention that the bag opener can be easily slid out of the pliable bag.

As one of skill in the art will appreciate, a non-stick surface for the surface of the bag opener 18 contacting a pliable bag is preferred in order to reduce any type of frictional contact between the device and a pliable bag, thus facilitating easy insertion and removal of the device from a pliable bag. In particular, the non-stick surface(s) should not stick to plastics typically used for pliable bags. Thus, the surface of the bag opener 18 opposite from the surface that supports the food stuff while it is being transported into a pliable bag should be, in one embodiment, coated with a non-stick material such as Teflon.

Moreover, as stated above, the flexible nature of the device should be such that it has a "memory" which returns the device to a substantially planar orientation when not in use. Such a planar orientation is desirable, for example, to facilitate storage of such device on top of a countertop or stored in a kitchen cabinet. Similarly, the device can be hung from a kitchen rack or kitchen cart so that it is easily accessible for use.

It should be understood that the material utilized to manufacture the bag opener 18, should be flexible in only one orthogonal direction at a time. That is, while having flexibility in a first direction so as to permit bending of the device so that, e.g., opposing edges (e.g., 19*a* and 19*b* of FIG. 2) of the device become nearer to one another, there is a sufficient amount of stiffness or rigidity in an orthogonal direction of the device (i.e., in the bag insertion direction) so as to facilitate insertion of the device into a pliable bag, and to maintain such rigidity during the transfer of food stuff into the bag. For example, for large pliable bags which hold, e.g., 2 gallons or more, such a rigidity in the bag insertion direction should be effective for supporting at least six to twelve pounds without buckling or bending. For smaller versions of pliable bags, the rigidity requirements may be relaxed somewhat depending on the food stuff being bagged. Accordingly, one of ordinary skill in the art will understand the particular thickness or strength of the device material to be used to achieve such operational objectives.

Figure 4:
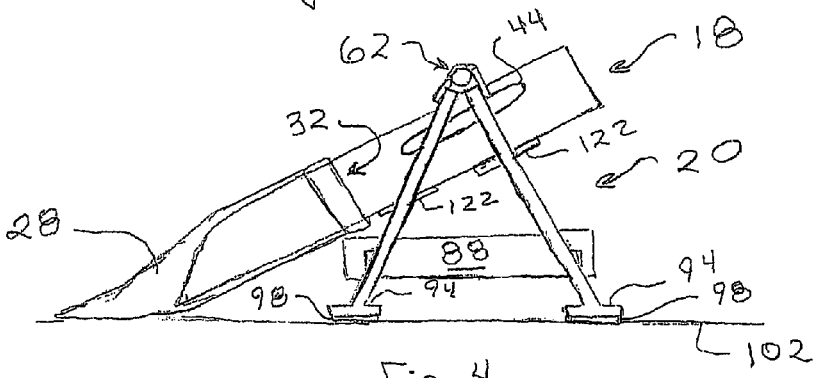
FIG. 4 shows a side view of an alternative embodiment of a bag opener 18 operatively positioned on an embodiment of the inclined support 20.

Referring now to FIGS. 1 and 4, this figure shows an operative embodiment of the device 18 (also denoted a "bag opener" herein), together with an accompanying inclined support 20, In particular, FIG. 1 shows a food stuff 24 that is being poured onto the bag opener 18 so that food stuff can flow by gravity into the pliable bag 28 whose opening 32 as well as a substantial depth of the bag 28 is being held taunt against the bag opener to thereby maintain the bag and its interior to open for accepting the food stuff 24. Accordingly, since the bag 28 supplies a sufficient counterforce to the resiliency of the bag opener 18 to flatten, the bag opener is maintained in the bowed configuration as shown in FIG. 1 even without the user supplying a bending force to the bag opener. Thus, a user can use both his/her hands to guide the food stuff 24 into the bag 28 without having to also manipulate and/or grasp the bag, or the bag opener 18.

Figure 2:
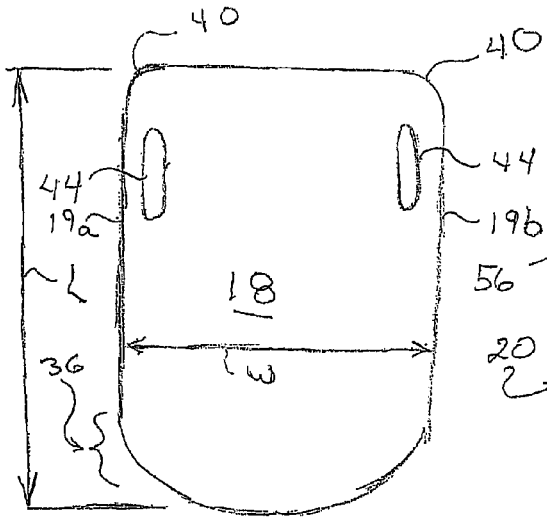
FIG. 2 is a plane view of an embodiment of a bag opener 18 of the present invention that is also shown in FIG. 1.

The embodiment of the bag opener 18 of FIG. 1 is also shown in FIG. 2, wherein it is in its planar or flat configuration. The bag opener 18 includes an arcuate (or at least a sufficiently smooth) contour for the pliable bag insertion end 36 so that the bag will not be snagged, or punctured when the insertion end is inserted into the bag 28 (in a bent configuration as described hereinabove). Additionally, the bag opener 18 also includes rounded distal corners 40 so that a user can not be injured or cut. The bag opener 18 further includes two hand holds 44 that can be ergonomically contoured for comfortable grasping of the bag opener, e.g., for bending or bowing the bag opener as shown in FIG. 1. In particular, note to bend the bag opener 18, the forces are applied to the side of the bag opener that is opposite to the side on which the food stuff is provided; i.e., the side that becomes convex when the bag opener is bowed for insertion into a bag 28.

Note that the bag opener 18 can be sized according to the size of bags 28 that are to be maintained in an open configuration (e.g., FIG. 1). In particular, the width "w" of the bag opener should be in the range of approximately at least 1⅜ to 2 times the largest linear dimension the opening of the bag is capable of assuming, and more preferably approximately 1½ times the largest linear dimension the opening of the bag is capable of assuming. Moreover, the length "L" of the bag opener 18 should be in the range of 1½ to 3 times the depth of the pliable bags 28 that are to be maintained open by the present invention. However, the length "L" may be less than the depth of the bags 28 if, e.g., the bag opener 18 is only inserted a short depth into the bags. In particular, the embodiment of the bag opener 18 shown in FIG. 5, insertion end 36 includes an expanded end 48, wherein when this embodiment of the bag opener is released just inside of a pliable bag opening 32, the expanded portion tends to secure the bag 28 on the bag opener and at least maintain a sufficiently interior bag volume near the opening 32 so that food stuff 24 can easily flow into the bag 28. However, note that in order to remove the present embodiment of the bag opener 18 from a bag 28, a user may be required to bend as well as withdraw the bag opener from the bag.

Figure 3:
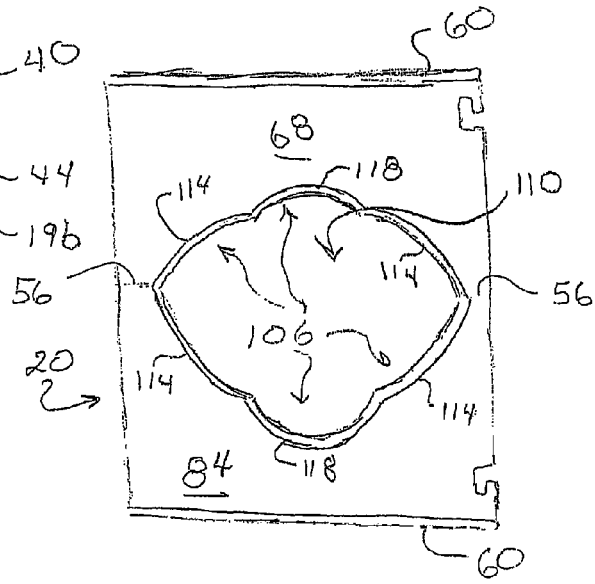
FIG. 3 shows another view of the inclined support 20 also shown in FIG. 1.

Referring now in more detail to the inclined support 20, this apparatus is shown in a plan view in FIG. 3. Thus, referring to FIGS. 1, 3, and 4, the inclined support 20 includes a support structure 52 which extends substantially between the fold 56 and the edges 60. The support structure 52 may be formed from a molded plastic such as results from an injection molding process, wherein the support structure is fixed in the shape shown in, e.g., FIG. 1. Alternatively, the support structure 52 may be formed from material that allows it to fold along fold 56. Accordingly, in this later embodiment the support structure 52 may be flattened when not used in the manner shown in FIG. 1, and in a flattened configuration will appear similar to what is shown in FIG. 3. Moreover, note that the support structure can be made from any of various plastics or metals, wherein the fold 56 can be provided by, e.g., two hinges (i.e., hinges 62, FIG. 4), Velcro, or even tape. Additionally, note that in the folding embodiment of the inclined support 20, various techniques may be used to secure the inclined support in its upright position. In the embodiment shown in FIG. 1, a simple cord 64 (or chain, etc.) may be attached to the hidden side (FIG. 1) of the support half 68 (by a snap, glue, eye hook, etc.), wherein substantially near the free end of the cord there is an expanded portion 72 (e.g., a knob, button, etc.). For securing the inclined support in the configuration of FIG. 1, a user may provide a portion of the cord 64 in the cord pinching cutout 76 so that the cord with the expanded portion 72 prevents the inclined support from flattening out unintendedly. FIG. 1 and FIG. 4 also show an alternative technique for maintaining a foldable inclined support 20 in its upright position; i.e., cutouts 80 may be provided in each of the support halves 68 and 84, wherein a cross support 88 may be fitted into the cutouts 80. More precisely, since the cross support 88 has mating cutouts 92, for securing the cross support 88 in the cutouts 80, each of the mating cutouts is secured in one of the cutouts 80. Accordingly, this later technique of securing the inclined support 20 in its upright position has the advantage that the inclined support is secured from both flattening and folding together.

Regarding the edges 60 of the inclined support 20, these edges may be expanded to provide better surface support for the inclined support. In one embodiment, the edges may have a non-skid rubber or other elastomeric covering or coating. Alternatively, such edges 60 may be expanded into feet 94 such as shown in FIG. 4. Moreover, the feet 94 may have a non-skid material 98 for contacting the surface 102 upon which the inclined support 20 is provided. Additionally, in one embodiment, a surface covering may be provided between the surface 102 and the material 98, wherein where the covering further assists in securing the inclined support 20 in its upright position. In particular, the covering may be, e.g., Velcro or an elastomeric pad.

Referring to FIGS. 1 and 3, the inclined support 20 also includes one or more bag opener supports (aggregately identified by the label 106) that are provided as the perimeter of a contoured hole 110 in substantially a central portion of the inclined support 20. In particular, there is at least two sets of one or more bag opener supports for each size of bag opener 18 and a corresponding pliable bag 28; i.e., a first set on the support half 84, and a second set on the support half 68. For example, FIG. 1 shows the bag opener 18 supported on outside support edges 114, wherein the support edges 114 on the support half 84 constitute the first set above, and the support edges 114 on the support half 68 constitute the second set above. Note that since the bag opener 18 is supported in an inclined position (e.g., relative to the surface 102), the support edges 114 on the support half 84 do not mirror the support edges 114 on the support half 68. Thus, in the embodiment of the FIGS. 1 and 3 where such support edges are arcuate segments, the support edges on the support half 84 extend further toward the edge 60 for this support half than the support edges 114, on the support half 68, extend toward the edge 60 of the support half 68. Also shown in FIGS. 1 and 3 are support edges 118 which are used for similarly supporting, e.g., a smaller sized bag opener 18. Accordingly, FIGS. 1 and 3 show an inclined support 20 that can provide appropriate inclined support for two differently sized bag openers 18 (i.e., having different widths "w"). However, note that the same bag opener 18 may be supported by a different combination of support edges 106 depending on the extent of the opening 32 of the pliable bag 28 used; i.e. the smaller the opening 32 in comparison to the width "w" of the bag opener, the greater the curvature of the bend of the bag opener when it is provided in the bag. Moreover, it is within the cope of the present invention that support edges for bag openers 18 having different and/or additional bowed curvatures may be provided by embodiments of the inclined support 20. Thus, e.g., there may support edges provided for three or more differently bowed bag openers 18.

It is important to note that the support edges (more generally the supports 106) need not continuous arcuate segments as shown. Instead, such supports may be of various configurations such as supports that are expanded to contact a greater amount of the convex surface of the bag opener 18. For example, FIG. 4 shows such expanded supports 122, wherein these expanded supports extend beyond the support halves in the direction food stuff flow into the bag 28. Additionally, such supports may be coated or otherwise provided with a material that will frictionally prevent the bag opener(s) 18 from slipping down the inclined support 20. Thus, such supports may be provided with a rubber or elastomeric covering such as the elastomeric bead 126 shown in FIG. 1. Additionally and/or alternatively, the "back" side of the bag opener 18 contacting such supports may include various ridges, roughened and/or non-skid areas in and about where such supports are likely to contact the inclined support 20. For example, this back side may include projections and/or indentions for mating with portions of the supports 106.

Figure 11:
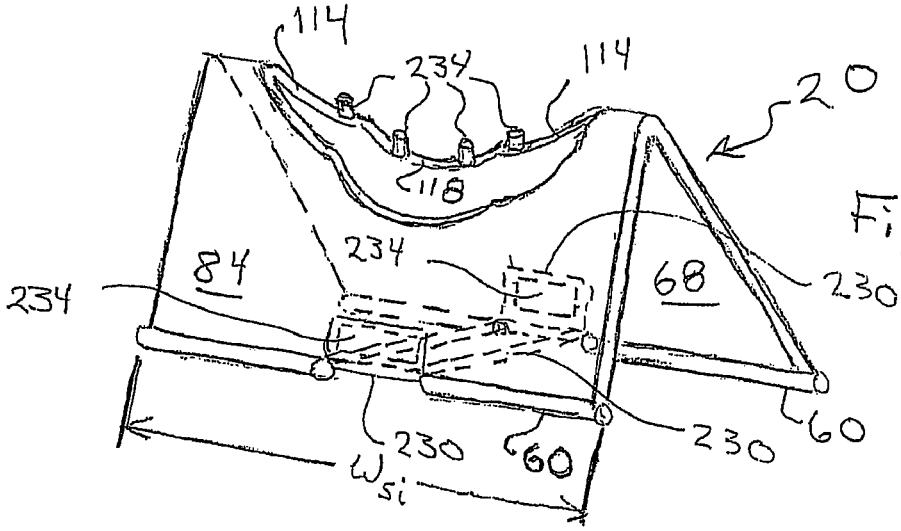
FIG. 11 shows a perspective view of another embodiment of the inclined support 20, wherein Velcro (or other hook and loop) material is used to maintain the inclined support in an upright position.
Figure 12:
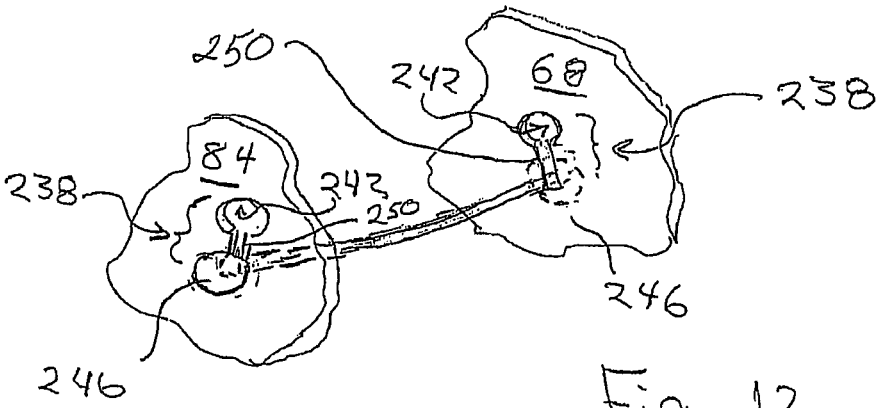
FIG. 12 shows a partial view of the support halves 68 and 84, each having a key hole therein for retaining end knobs.

FIGS. 11 and 12 illustrate additional embodiments of the inclined support 20, and especially, additional techniques for maintaining the inclined support 20 in an upright position. Accordingly, referring to FIG. 11, there is a Velcro strap 230 that extends between the support halves 68 and 84 (only partially shown in FIG. 11). Thus, the Velcro strap 230 (more generally, a loop material) attaches to a patch of hook material 234 glued, or otherwise secured, to the outwardly facing opposed surfaces of the support halves 68 and 84. Moreover, the portion of the strap 230 that is positioned between the two support halves 68 and 84 may be stiff or rigid so that it prevents the inclined support 20 from both flattening and the support halves from folding together as discussed hereinabove. Additionally, note that the strap 230 connects the two support halves 68 and 84 together substantially in the center of the inclined support 20 width "$w_{si}$" so that greater stability is provided to the upright inclined support. Moreover, FIG. 11 also shows pegs 234 residing on the support edges 114 and 118, wherein these pegs can be mated with, e.g., peg holes provided in an embodiment of the bag opener 18 for thereby securing the bag opener in its inclined position. Of course, as one skilled in the art will understand, additional pegs may be provided on the support edges of support half 84. Also, it is important to recognize that such pegs can be combined with other techniques for securing the inclined support 20 in its upright position, including those techniques described hereinabove.

FIG. 12 shows yet another technique for securing the support halves 68 and 84 together, wherein a key shaped opening 238 is provided in each of the support halves 68 and 84. Each such opening includes: (i) an expanded opening 242 that is of sufficient size to allow a corresponding one of the knobs 246 to pass therethrough, and (ii) a lower slot 250 through which the corresponding knob 242 can not pass through, but which the cord 254 that connects the knobs 242 can pass through. Accordingly, in using the present technique for securing the inclined support 20 in an upright position, a user inserts each knob 246 through one of the expanded openings 242 and then slides each knob downwardly into the corresponding lower slot 250. Thus, since the knobs 246 can not exit the support halves via the lower slots, the inclined support remains in an upright position.

The general geometric shape of the bag opener 18 can be of various desired shapes so long as the objective of opening up a pliable bag to create a three-dimensional space through which a food stuff can be inserted is achieved, and (at least in some embodiments) wherein the bag opener can be secured in an inclined orientation on an embodiment of the inclined support 20. Preferably, a generally shield shape (or "U" shape as described in the Summary section above) may be provided as shown in FIG. 2. However, the bag opener 18 can also be provided in other shapes, such as the bag opener embodiments shown in FIGS. 5 through 8, wherein FIGS. 5 and 6 generally correspond to the "T" embodiment referred to in the Summary section, and FIG. 7 corresponds to the "∇" embodiment referred to in the Summary section. However, still other embodiments are clearly within the scope of the invention, as one of ordinary skill in the art will understand.

Figure 6:
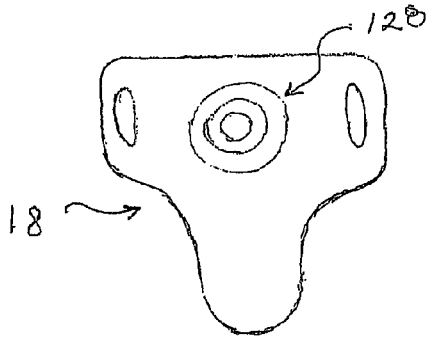
FIG. 6 illustrates another alternative embodiment of a bag opener 18 according to the present invention.

Moreover regarding FIG. 6, this embodiment shows that indicia can be provided on the surface of bag opener 18. Such indicia 128 may be used for assisting a user in determining the quantity of, e.g., a food stuff 24 residing on the bag opener 18. In FIG. 6, such indicia 128 are illustrated by concentric circles, wherein each such circle is indicative of an approximate quantity of one or more food stuffs 24 provided within (and substantially covering) the circle. Thus, a user may be able to approximately determine the size of pliable bag 24 that will be needed to contain the food stuff residing on bag opener 18 prior to it being bowed and, e.g., inclined on the inclined support 20 (i.e., the bag opener will likely be in a flat or planar horizontal orientation). Note, the indicia 128 may be calibrated so that each area (e.g., a circle) corresponds approximately to a volume of each of one or more food stuffs 24 that can be easily piled in the area by a user when, e.g., the user dumps or pours a food stuff onto the bag opener (in, e.g., a horizontal orientation). Moreover, note that such indicia need not be entirely concentric as shown, but instead, there may be a plurality of non-overlapping areas, each optionally providing concentric areas for assisting a user measuring the quantity of food stuff provided on the bag opener 18. Moreover, such indicia defined areas can be of substantially any convenient shape, e.g., rectangles, triangles, etc. Additionally, there may be indicia for areas substantially corresponding to cooking measurements such as a tablespoon (or multiples thereof), a teaspoon (or multiples thereof), etc. Accordingly, for an application of the present invention for mixing dry ingredients such conventional measurements provided on the surface of the bag opener 18 can be of substantial convenience to the user.

Figure 8:
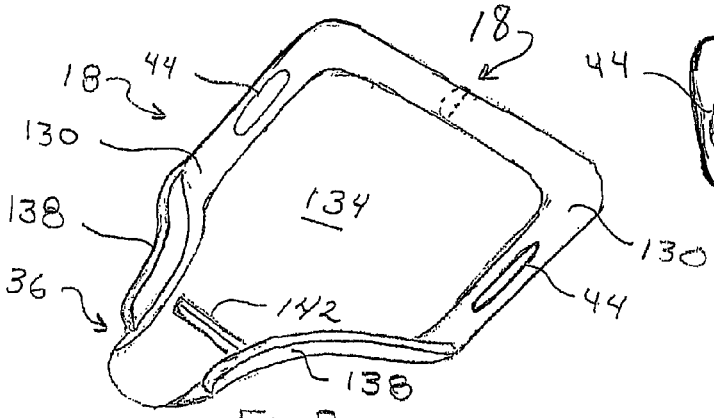
FIG. 8 shows a perspective view of yet another embodiment of a bag opener 18 according to the present invention.
Figure 5:
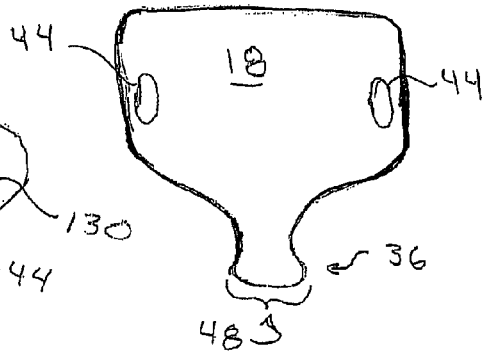
FIG. 5 illustrates an alternative embodiment of a bag opener 18 according to the present invention.
Figure 9:
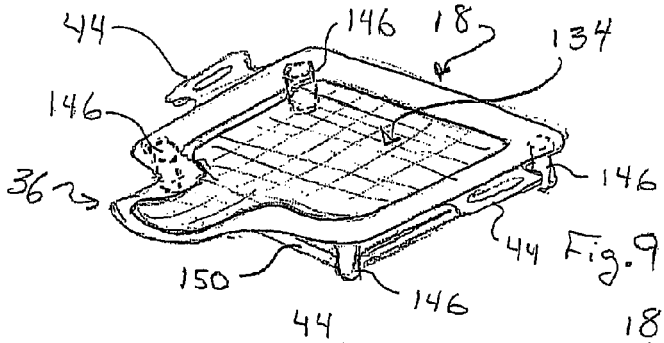
FIG. 9 shows a perspective view of yet another embodiment of a bag opener 18 according to the present invention.
Figure 10:
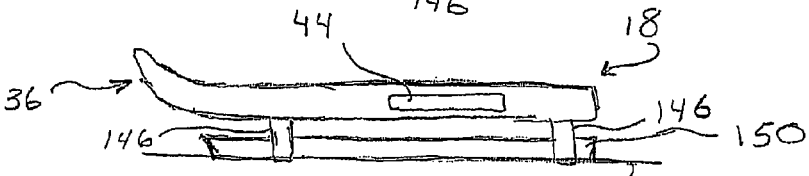
FIG. 10 shows a side view of the embodiment of the bag opener 18 of FIG. 9.

FIGS. 8 through 10 show additional embodiments of the bag opener 18. The embodiment of FIG. 8 shows a bag opener 18 having a raised perimeter 130. Thus, this embodiment allows a user to place and/or process food stuffs that have liquid therewith (e.g., water or oil) on a center portion 134 while the bag opener is in a substantially horizontal or flat position without the liquid spilling over the sides of the bag opener 18. That is, the raised perimeter 130 in conjunction with a slightly raised bag insertion end 36 (also illustrated in the bag opener 18 embodiment of FIG. 10) allows a user to, e.g., use the bag opener 18 as a cutting board assuming the center portion 134 is composed of an appropriate bendable and resilient cutting material such as an amorphous polypropylene co-polymer (alternatively known as 1-propene, polymer with ethene) as disclosed in U.S. Pat. No. 5,472,790 filed Jun. 13, 1994 by Thompson which is fully incorporated herein by reference. More generally, such a bendable and resilient cutting board material should be sufficiently hard to resist perforation and spalling. However, the sheet material for such a cutting board should be not dull most knives or other kitchen implements. Thus, a material having a Rockwell hardness of between 72 and 90 may be used. Additionally, it is desirable for the cutting board material to have, in one embodiment, sufficient cantilever beam strength when folded or bent to support a substantial amount of food stuff, or other items, at an unsupported end of the sheet material from where it is being held or secured. In particular, such a sheet material having a thickness between 0.008 inches and 0.060 inches (and more preferably the thickness be in the range of 0.008 inches to 0.030 inches) in combination with a flexural modulus of between 55,000 psi and 200,000 psi is suitable. In one exemplary embodiment, the thickness of the cutting board material may be approximately 0.010 inches and the flexural modulus is 145,000 psi, which results in a sheet material that may be easily bowed around, e.g., a food stuff flow line into a pliable bag 28 when held or supported at substantially only the end of the bag opener 18 opposite the insertion end 36. In particular, weights in excess of five ounces can be supported in this manner at distances as great as 12 to 14 inches from the unsupported end.

To further specify such a cutting board material, the material should, at least in one embodiment, have the following properties:

(a) a softening point in excess of 126 degrees C.;
(b) a Rockwell hardness of 80 as determined by the ASTM Test Method D785;
(c) a melt-flow rate of 1.0 degrees Centigrade per minutes as determined by the ASTM Test Method 1238;
(d) a density of 0.900 gm/CM.sup.3 as determined by the ASTM Test Method 1505;
(e) a tensile modulus of 150,000 psi as determined by ASTM Test Method D638; and
(f) a flexural modulus of 145,000 psi as determined by the ASTM Test Method 790.

Various types of polypropylene having the above-described physical properties are believed to be manufactured by Huntsman Corp. 500 Huntsman Way, Salt Lake City, Utah 84108, and was previously manufactured by Rexene Corp. under the brand name REXENE RESINS Polypropylene 9231.

Accordingly, with the cutting board material described hereinabove, an embodiment of the bag opener 18 may be used for slicing, dicing and/or mashing liquid laden food stuffs such as watermelon, olives, tomatoes, grapes, eggs, etc., wherein the associated liquid remains on the bag opener 18, and in particular, on the center portion 134. Additionally, note that the embodiment of FIG. 8 further includes sides 138 that project away from the surface of the center portion 134, wherein these sides assist in guiding a food stuff 24 residing on the center portion 134 into a pliable bag 28. Accordingly, once a pliable bag 28 is provided on the bag insertion end 36 (e.g., by bending or bowing the bag opener as previously described, or by merely sliding a pliable bag 28 onto the insertion end so that the sides 138 substantially maintain the bag in an open configuration), the bag opener can be inclined so that the food stuff on the center portion slides into the bag. Note, in one embodiment, if it is desired that excess liquid on the center portion 134 not be provided in the pliable bag 28, a mesh or slot(s) can be provided in the center portion 134 so that such liquid can drain through the center portion. Alternatively or additionally, such a mesh or slot(s) can be provided on the raised portion of the bag insertion end 36 (or immediately adjacent thereto) such that the mesh or slot(s) is raised above the majority of the center portion 134 by an amount at least as much as the maximal height that the raised perimeter 130 rises above this majority of the center portion. FIG. 8 shows an illustrative positioning of such a mesh or slot(s) identified by the label 142.

Referring to FIGS. 9 and 10, these embodiments of the bag opener 18 provide a mesh for the entire center portion 134 (or substantially so). Accordingly, the present embodiment is particularly useful for straining or draining liquids from food stuff 24 prior to the food stuff being provided in a pliable bag 28 in a manner described hereinabove. For example, the bag opener 18 of FIGS. 9 and 10 may be particularly useful for washing vegetables or fruit prior to providing such food stuff in a bag 28. Additionally, the present embodiment may be used for draining grease from (and cooling) fried foods such as fried chicken prior to such a food stuff being provided into a pliable bag 28 as, e.g., described hereinabove. Thus, the bag opener 18 of FIGS. 9 and 10 may optionally include legs 146 so that this bag opener can be raised above a supporting surface 102. Accordingly, when draining grease or other oils, it may be particularly useful to have a container 150 underneath the bag opener to catch such liquids. Additionally, note that the hand holds 44 are exterior to the main body of the bag opener 18 rather than being integral therewith as in the previous embodiments. Such exterior hand holds can readily be provided in any of the bag opener embodiments described hereinabove instead of integral hand holds, as one of ordinary skill in the art will understand.

Figure 13:
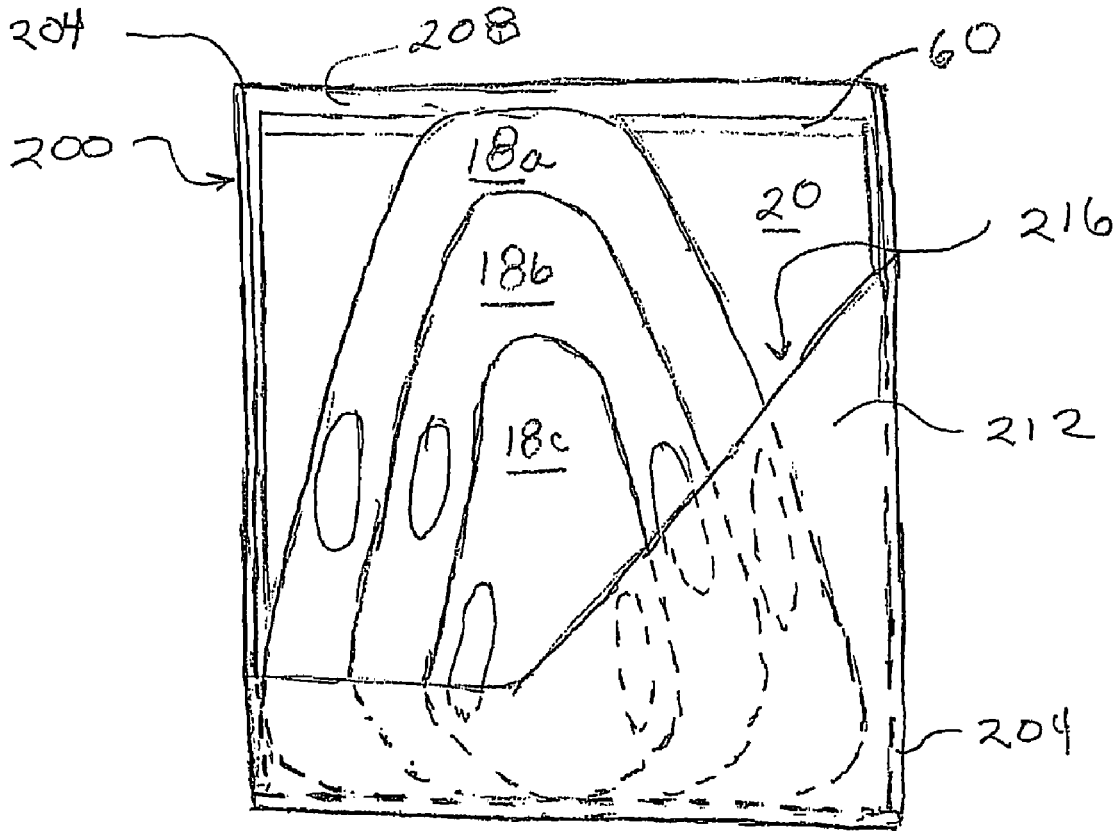
FIG. 13 shows a front view of an enclosure 200 for storing one or more of differently sized bag openers 18 (labeled here as 18*a*, 18*b*, and 18*c*) together with, e.g., one or more embodiments of the inclined support 20.

FIG. 13 shows an enclosure 200 for storing and/or distributing one or more of differently sized bag openers 18 (labeled here as 18*a*, 18*b*, and 18*c*) together with, e.g., one or more embodiments of the inclined support 20. The enclosure 200 may be comprised of cardboard or other packaging material, or alternatively may be comprised of a more durable material such as plastic, wood or metal. The enclosure 200 may have sides 204 projecting forwardly (in the view of FIG. 13) from a generally planar back 208, wherein the sides have attached thereto a front panel 212 to thereby form a pocket 216 into which the bag openers 18 and optionally at least one inclined support 20 can be provided. Thus, a user may store the enclosure 200 together with its contents conveniently away in, e.g., a kitchen cabinet or hang the enclosure 200 on a wall by any of a number of well known techniques. In an alternative embodiment, the front panel 212 may be attached directly to the back 208. In this later embodiment, the front panel may be a plastic that is heat sealed to a corresponding portion of the perimeter of the back 208 to thereby form the pocket 216. Thus, a user can easily retrieve an appropriately sized bag opener 18 and (if necessary) an inclined support 20 from the enclosure 200 for providing food stuff 24 in one or more pliable bags 28, and then upon completion (and washing or cleaning) of the used components of the invention, insert these components back into the pocket 216 for convenient storage.

In another embodiment for storing one or more bag openers 18, each such bag opener may have a hole provided therein substantially centered between the corners 40 (e.g., FIGS. 1 and 2) so that differently sized bag openers 18 can be hung together on a common hook such that they will be oriented with respect to one another similarly to those of FIG. 13 with the exception that the bag openers would be upside down from what is shown in FIG. 13. Note that such an opening may centered on a raised perimeter 130 such as in FIG. 8, and more specifically, on or near where the cross sectional dashed line is shown for this figure. Thus, in this later embodiment, the hole will not be susceptible to allowing liquids and small food stuff pieces to enter the hole and escape from the bag opener.

While the preferred embodiment of the bag opener 18 is normally a flat planar piece of flexible plastic that can be configured into a substantially U-shaped shape, or rolled over upon itself for insertion into a pliable bag 28 such that the resiliency of the bag opener maintains the bag in an open configuration, various other types of configurations are also within the scope of the present invention. In particular, an embodiment of the bag opener 18 may be provided wherein a user can vary its width "w" (FIG. 2) due to overlapping portions wherein the overlap can be varied for adjusting the width "w".

In one embodiment of the invention, the bag opener 18 is made from a single sheet of such as an amorphous polypropylene co-polymer as described above, however, other materials, such as plastic, thin metal, cardboard, etc. can be used, depending upon the application to which the bag opener of the present invention is applied, to create the bag opener 18 and/or the inclined support 20. In particular, any material may be used so long as the material is appropriately resiliently bendable, and is able to be cut, molded or otherwise formed to the appropriate size for the food stuff (or other flowable item) with which the resulting bag opener is desired to be used. For example, a bag opener 18 and corresponding inclined support 20 for filling burlap bags with potatoes may be substantially larger and stronger than an embodiment of the bag opener and corresponding support for filling quart bags with peas. However, it is believed that some particularly useful bag opener sizes are those appropriate for sandwich size bags, pint size bags, quart size bags, gallon size bags, and two gallon size bags.

In various embodiments, the device 18 has a food stuff insertion edge 20 that is rounded to ease the device into the pliable bag as shown in FIGS. 1, 2, 5-9. However, the rounded edge (i.e., insertion edge 36) may be circular, elliptical, or various other curves including compound curves such as "S" curves. Moreover, in one embodiment, substantially only the insertion end 36 is bendable for fitting into a bag 28 in a manner that retains the bag in an open configuration.

Figure 14:
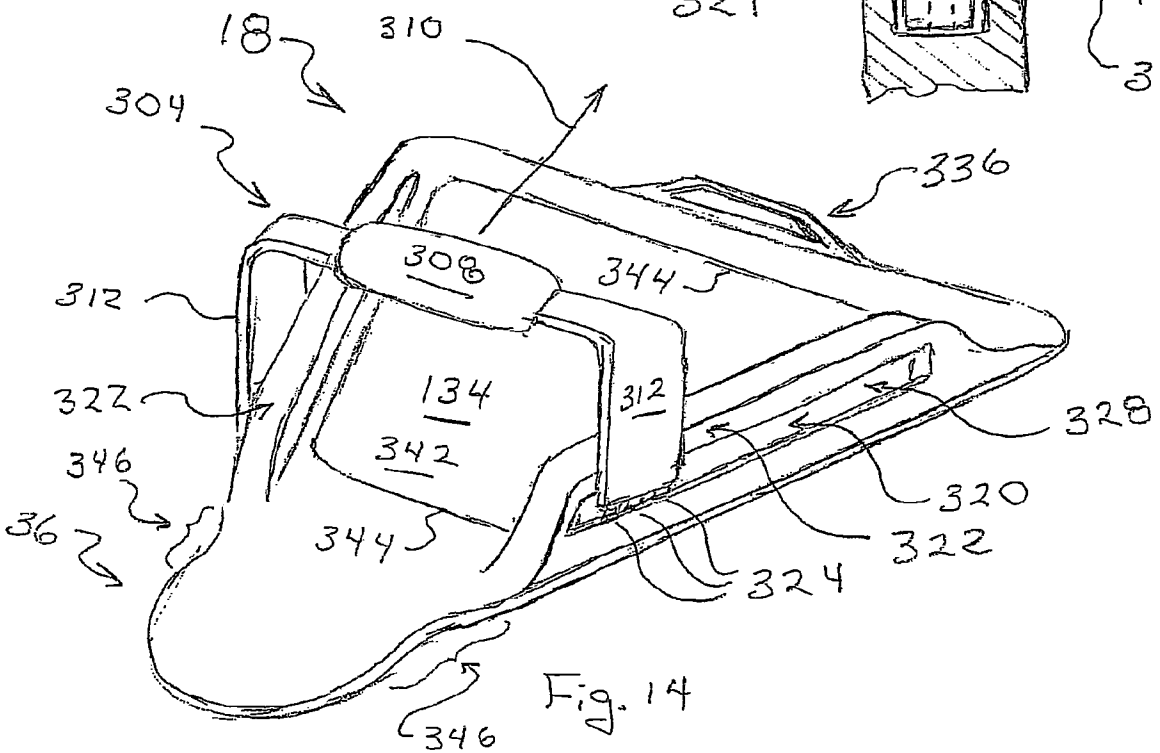
FIG. 14 shows a further embodiment of the bag opener 18 of the present invention.

In some embodiments, such as the embodiment of FIG. 14, the bag opener 18 may include a push/pull mechanism 304 that allows a user to pull a handle 308 operatively provided above the insertion end 36 (when it is in a horizontal position as shown). In particular, when the handle 308 is pulled in the direction of arrow 310 (which is generally the opposite direction to flow of food stuff into a pliable food stuff bag 28), vertical handle sides 312 cause the bag opener 18 (and especially the insertion end 36) to bend or bow as described above. For example, the vertical handle sides 312 may be slidably attached to (or associated with) non-parallel rails or guides 320 provided in walls 322 on opposite sides of, e.g., at least the center portion 134. In particular, the rails or guides 320 (only one of which is shown in FIG. 14) are generally oriented in the direction of the flow of food stuff 24 into a bag 28 (e.g., such rails or guides may angularly deviate from the direction of food stuff flow into a bag by about 5 degrees to 60 degrees). Thus, when the push/pull mechanism 304 contacts the non-parallel rails 320 (e.g., via rollers 324) at generally their narrowest position apart (as shown in FIG. 14), there is substantially no bending forces applied to the bag opener 18, and when the mechanism 304 contacts the rails 320 at generally the opposite ends 328 of the guides, bending forces are applied to the bag opener 18. Moreover, when the user pushes on the handle 308, the insertion end 36 tends to flatten out. Accordingly, instead of directly bending or bowing the bag opener 18, the user merely pulls or pushes on this handle 308 to obtain a desired degree of bowing for providing a food stuff bag 28 on the insertion end 36. Subsequently, the user may relax the bowing of the insertion end 36 by pushing somewhat on the handle until the bag is appropriately secured to the insertion end in an open configuration. Note that to more easily move the handle 308 along the guides 320, an additional handle such as handle 336 may be provided.

Figure 15:
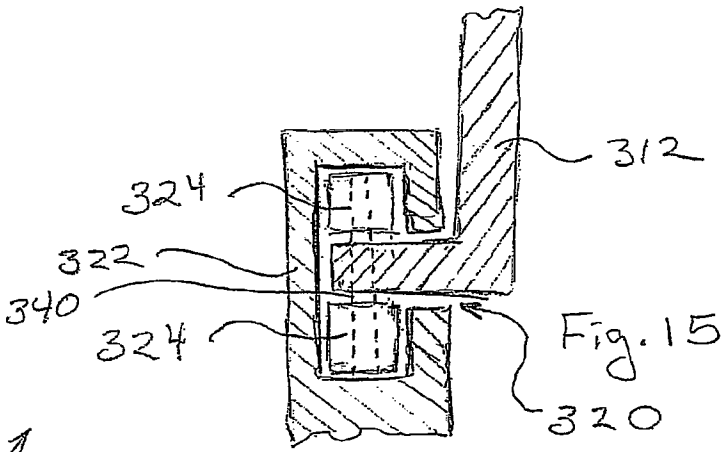
FIG. 15 shows a more detailed view of the rollers 324 and a cross section of the guide 320 within which the rollers travel.

As shown in FIG. 15, the rollers 324 mentioned above allow the push/pull mechanism 304 to roll within the guide 324. In particular, FIG. 15 shows a cross section of a portion of one of the walls 322, a cross section of a corresponding one of the vertical handle sides 312, and the guide 320, wherein rollers 324 are shown in the guide. In the present embodiment, the rollers 324 are provided in pairs along a common shaft 340 for rotation thereon. Note that as shown in FIG. 14, there may be a plurality of such pairs of rollers 324 (e.g., three such pairs).

Additionally, note that the center portion 134 may be provided as separable component 342 of the bag opener 18. For example, in FIG. 14 the component 342 may replaced by a different component having a different use. Thus, a component 342 provided substantially of a flexible cutting board material may be snapped (or otherwise secured) into place, generally along seam 344, as shown in FIG. 14 for a first task of food slicing and bagging. Then the flexible cutting board material can be removed from the remainder of the bag opener 18 and another component 342 provided therein such as a mesh for washing, straining or drying a food stuff 24 prior to being bagged. Thus, any of the variously described surfaces or textures for the food support surface can be provided in such a separable component 342. Further note that in the embodiment of FIG. 14, there may be brake or stop (not shown) included to the fix the bag opener 18 in a desired bent configuration. For example this may be desirable for bags 28 that distort or tear easily. Also note that the bag insertion end 36 includes a compound curved shape for its perimeter, wherein at the locations designated by 346, the perimeter is convex on both sides of a concave portion. Such perimeter portions 346 can assist in keeping a pliable food stuff bag 28 on the bag insertion end 36.

Figure 7:
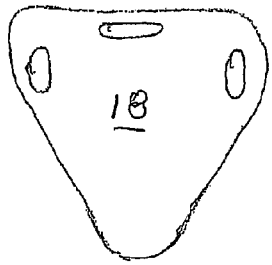
FIG. 7 illustrates another alternative embodiment of a bag opener 18 according to the present invention.

In another related embodiment, the handle may be pushed to bow the insertion end 36, pulled for relaxing such. Thus, if a package of bags 28 is available, a user may need only push the handle to bow the insertion end, open the next bag so that the insertion end is directed to the interior of the bag, and then pull on the handle allowing the resilient insertion end to expand within the bag and thereby retain it in an open configuration. Note that rails or other attachments (e.g., roller/cam tracks), to the underneath side of the bag opener 18 (or sides such as sides 138, FIG. 7) may be used to translate the linear push/pull motion into forces for bending the bag opener, and reducing such forces so that the bag opener resiliently tends to flatten out. One skilled in the art will readily understand how to combine or integrate such a push/pull mechanism with an embodiment of the bag opener 18. In particular, the embodiment shown in FIG. 7 is illustrative in this regard in that such roller/cam tracks may be provided on the sides 138, and more particularly, on the surfaces of these sides that face outwardly from the center portion 134, since such surfaces are non-parallel, but are generally oriented in the direction of the flow of food stuff into the bag 28 (e.g., a substantial portion of each of these surfaces angularly deviate from the direction of food stuff flow by about 5 degrees to 60 degrees).

In still other embodiments of the invention, the bag opener 18 may be manufactured from a material upon which it is easy to print so that the device can have the above described measuring indicia provided thereon. Additionally, the device can be manufactured with a particular graphic and/or printing to reflect its source and origin.

The actual dimensions of the present bag opener 18 can be of any sort desired in order to facilitate the changing of various sized food stuffs in various sized pliable bags. Preferably, however, the width of the device 18 should exceed the width dimensions of any particular pliable bag in order to facilitate the creation of a three-dimensional space within the interior of the pliable bag and thereby accommodate the insertion of a food stuff with relative ease. In particular embodiments, therefore, the width of the device 18 is at least about 1½ times the width of a pliable bag, and in other embodiments, can exceed twice the width of the pliable bag. The lengthwise dimension of the bag opener 18 should be suitable for fitting within the complete interior length of a pliable bag. In at least some embodiments, the length of the bag opener 18 should exceed by several inches the length of a pliable bag 28 into which the bag opener 18 is to be inserted in order to facilitate easy insertion and removal of the bag opener without encountering any hindrance from the pliable bag itself. In one embodiment, the bag opener 18 is preferably configured so that when inserted into a pliable bag 28, the bag opener extends substantially to the end of a pliable bag in order to facilitate the sliding of a food stuff 24 into the terminus of the pliable bag.

In various embodiments of the present invention, the bag opener 18 may be provided with a plurality of peel-off layers so that the bag opener can be used with incompatible food stuffs without the user taking time to wash or wipe down bag open food stuff supporting surface, and instead, the user can merely remove the outermost layer and continue filling pliable bags 28 with a different food stuff 24. In some embodiments of the present invention, the bag opener 18 may be manufactured from a material that is inherently anti-bacterial due to, e.g., an anti-bacterial agent being embedded within the material of the bag opener.

In another embodiment, the bag opener 18 may be disposable so that after some relatively small number of uses (e.g., 1 to 5 uses), the bag opener is replaced. Such a disposable bag opener 18 can be particularly useful for collecting and depositing trash or debris in large plastic trash bags. Accordingly, such disposable bag openers 18 may be made of a bio-degradable plastic or a cardboard laminate thereof.

While various embodiments of the present invention have been described in detail, it will be apparent that further modifications and adaptations of the invention will occur to those skilled in the art. It is to be expressly understood that such modifications and adaptations are within the spirit and scope of the present invention, as set forth in the following claims.

What is claimed is:

1. A device for inserting a food stuff into a food stuff bag, comprising:

a substantially flexible resilient food stuff support having at least one food stuff supporting element that has at least a first end for insertion a short depth into an opening of a pliable bag;

a support bending mechanism for applying one or more forces wherein when the forces are applied, the food stuff support bends so that at least the first end deforms from a first configuration to a second configuration for insertion of the first end through the bag opening and into an interior of the bag;

wherein when the forces are reduced, the first end changes shape toward the first configuration for holding a portion of the bag and for providing an open volume within the bag for transferring a food stuff to the interior of the bag; thereby holding the bag open and giving the bag a shape suitable for pouring a foodstuff into the bag, with said bag acquiring a shape such that a foodstuff may easily be inserted in said bag with reduced contact; and a support having an upright arrangement for supporting the food stuff in an orientation for transferring the food stuff into the bag, and a different substantially flattened arrangement for storage.

2. The device as set forth in claim 1, wherein said flexible resilient food stuff support comprises lexan polycarbonate.

3. The device as set forth in claim 1, wherein when a bag insertion end is inserted into a pliable bag, the bag is maintained in an open configuration during the transfer of the foodstuff on the device to the bag.

4. The device as set forth in claim 1, wherein device is generally "U" shaped when viewed from its operative position on a countertop.

5. The device as set forth in claim 1, wherein the first end has no sharp corners that could snag, tear or cut the bag.

6. The device as set forth in claim 1, wherein said first end has a smooth contour having tangents that are acutely angled relative to the general direction of the flow of food stuff from the bag opener into a food stuff bag.

7. The device as set forth in, claim 1, wherein said first end has contoured edges.

8. The device as set forth in claim 1, wherein the device has no pointed or sharp portions that could damage a pliable bag, said first end having edges that are sufficiently dull so as to not cut a bag.

9. The device as set forth in claim 1, wherein said device includes a gripping structure to facilitate insertion and removal of a pliable bag.

10. The device as set forth in claim 1, wherein said device includes an apparatus for supporting the bag opener in a position without requiring a user to manually maintain the bag opener in said position while depositing a food stuff into a pliable bag.

11. The device as set forth in claim 1, wherein the bag remains on the support for an extended period of time while the bag is being filled.

12. The device as set forth in claim 1, wherein a three-dimensional cavity is formed inside the interior regions of a pliable bag and a food stuff can be readily inserted within such cavity and wherein, once a food stuff is inserted, the device is removed from the pliable bag.

13. The device as set forth in claim 1, wherein said device is in a substantially planar orientation when not in use.

14. The device as set forth in claim 1, wherein said device facilitates holding pliable bags able to hold 2 gallons of food stuff.

15. The device as set forth in claim 1, wherein a substantial depth of the bag is held taunt by the device to thereby maintain the bag and its interior to open for accepting the food stuff.

16. The device as set forth in claim 1, wherein a user can use both his/her hands to guide the food stuff into the bag without having to also manipulate and/or grasp the bag or the device.

17. The device as set forth in claim 1, wherein the device includes rounded distal corners so that a user can not be injured or cut.

18. The device as set forth in claim 1, wherein the device includes legs so that the device is raised above a supporting surface.

19. The device as set forth in claim 1, wherein the device has an insertion edge that is rounded to ease the device into the pliable bag and substantially only the first end is bendable.

20. A method of inserting a food stuff into a food stuff bag comprising:

(a) first providing a pliable food stuff bag having an opening to an interior of the bag;

(b) second providing a substantially flexible resilient food stuff support that is generally "U" shaped when viewed from its operative position on a countertop, said support having at least one food stuff supporting element that has at least a first end for insertion a short depth into an opening of a pliable bag, said first end having an edge that is curved and opposing sides that are substantially straight, said support further having a support bending mechanism for applying one or more forces, wherein when the forces are applied, the food stuff support bends so that at least the first end deforms from a first configuration to a second configuration for insertion of the first end through the bag opening and into an interior of the bag, wherein when the forces are reduced, the first end changes shape toward the first configuration for holding a portion of the bag and for providing an open volume within the bag for transferring a food stuff to the interior of the bag, thereby holding the bag open and giving the bag a shape suitable for pouring a foodstuff into the bag, with said bag acquiring a shape such that a foodstuff may easily be inserted in said bag with reduced contact, said support having an upright arrangement for supporting the food stuff in an orientation for transferring the food stuff into the bag, and a different substantially flattened arrangement for storage;

(c) moving the support from a first substantially flat position to a second upright position;

(d) applying a force to the food stuff support bending mechanism to bend said at least first end so that at least the first end deforms from the first configuration to the second configuration;

(e) inserting the first end into the interior of the bag while the first end is in the second configuration;

(f) allowing the first end to change shape toward the first configuration, (g) forming a three-dimensional cavity inside the interior of the bag so that a food stuff can be readily inserted within such cavity;

(h) transferring a food stuff to the interior of the bag when the bag is supported on the support in said upright position; and (i) removing the bag from the support once a food stuff is inserted in the bag.

* * * * *